US009068779B2

(12) United States Patent
Eyfa

(10) Patent No.: US 9,068,779 B2
(45) Date of Patent: Jun. 30, 2015

(54) WATER-COOLED BURNER AND/OR INJECTOR PANEL KITS, WATER-COOLED BURNER AND/OR INJECTOR PANEL APPARATUS, AND METHODS OF USING THE SAME

(71) Applicant: Air Liquide Advanced Technologies U.S. LLC, Houston, TX (US)

(72) Inventor: Yury Eyfa, Smyrna, GA (US)

(73) Assignee: L'Air Liquide SociétéAnonyme Pour L 'Étude Et L Eploitation Des Procedes Georges Claude, Paris (FR)

( * ) Notice: Subject to any disclaimer, the term of this patent is extended or adjusted under 35 U.S.C. 154(b) by 134 days.

(21) Appl. No.: 13/852,747

(22) Filed: Mar. 28, 2013

(65) Prior Publication Data

US 2014/0265067 A1 Sep. 18, 2014

Related U.S. Application Data

(60) Provisional application No. 61/801,487, filed on Mar. 15, 2013.

(51) Int. Cl.
*F27D 9/00* (2006.01)

(52) U.S. Cl.
CPC ..... *F27D 9/00* (2013.01)

(58) Field of Classification Search
CPC ..... F27D 9/00; F27D 1/12; F27B 3/24
USPC ..... 266/46, 193, 194, 241; 373/76, 77
See application file for complete search history.

(56) References Cited

U.S. PATENT DOCUMENTS

| | | | | |
|---|---|---|---|---|
| 4,703,336 | A | 10/1987 | Ovshinsky et al. | |
| 5,166,950 | A | 11/1992 | Jouvaud et al. | |
| 5,373,530 | A | 12/1994 | Perrin | |
| 5,444,733 | A | 8/1995 | Coassin et al. | |
| 5,471,495 | A | 11/1995 | Berger et al. | |
| 5,802,097 | A | 9/1998 | Gensini et al. | |
| 6,108,363 | A * | 8/2000 | Haissig | 373/77 |
| 6,212,218 | B1 | 4/2001 | Shver | |
| 6,289,035 | B1 | 9/2001 | Shver | |
| 6,342,086 | B1 | 1/2002 | Shver | |
| 6,372,010 | B1 | 4/2002 | Shver et al. | |
| 6,614,831 | B2 | 9/2003 | Shver | |
| 6,999,495 | B2 | 2/2006 | Popenov et al. | |
| 2014/0265067 | A1 * | 9/2014 | Eyfa | 266/46 |

* cited by examiner

*Primary Examiner* — Scott Kastler
(74) *Attorney, Agent, or Firm* — Christopher J. Cronin

(57) ABSTRACT

A burner and/or injector panel includes at least two cooling circuits that may be connected in series with a flexible hose or rigid pipe connected to the circuits behind a rear face of the panel or connected in parallel to a source of cooling water by independently connecting each cooling circuit to the cooling water source without connecting the flexible hose or rigid pipe.

7 Claims, 8 Drawing Sheets

WATER-COOLED BURNER AND/OR INJECTOR PANEL KITS, WATER-COOLED BURNER AND/OR INJECTOR PANEL APPARATUS, AND METHODS OF USING THE SAME

CROSS-REFERENCE TO RELATED APPLICATIONS

This application claims the benefit of U.S. Provisional Application No. 61/801,487 filed Mar. 15, 2013, the disclosure of which is incorporated herein by reference.

BACKGROUND

The present invention relates to a water cooled panels for burners and/or injectors used in a melting furnace, especially for use in an electric arc furnace (EAF).

In general, an EAF is used to make steel by application of an electric arc to melt one or more of scrap metal and/or other alternative iron bearing feed stocks and alloys that are placed within the furnace. One type of EAF has hemispherical lower bowl made of metal. The bottom and sides of the lower bowl are lined with a refractory material forming the hearth. Extending vertically from the bowl are water-cooled sidewall panels. Extending between the sidewalls over a molten bath of metal (contained by hearth) is a roof. Over the sump area, the balcony ceiling (also called the "banana panel") may also be provided with water cooled panels. The EAF may also include one or more burners, one or more injectors (such as lances or injectors for injecting particulate solids like carbon), or a combined burner and injector apparatus.

Burners and/or injectors are used in EAFS for the purpose of providing heat and chemical energy to the melt and are typically mounted through holes in water cooled wall panels or sump balcony panels. Burners and/or injectors are subjected to harsh conditions in EAFs, including intense radiative heat from arcing of the electrodes, convective heat transfer from hot furnace gases, slagging caused by splashing slag, and blowback of injected oxygen. In order to prolong the useful life of such burners and/or injectors, they are often mounted in panels, in particular water cooled panels, that at least partially shield them from such harsh conditions. When the burner and/or injector is mounted in the panel, the combined apparatus (the panel and the burner and/or injector) is called a burner and/or injector panel apparatus.

The panel is more or less a protective shield that surrounds the sides of the burner and/or injector but which includes an orifice into which a burner and/or an injector (or injectors) are inserted. The orifice goes through the front face of the panel to allow the fuel and oxidant to be injected (in the case of a burner) or to allow the oxidant and/or solid particles (such as carbon) to be injected (in the case of an injector). The panel may instead have multiple orifices to accommodate both a burner and an injector or a burner and multiple injectors. The panels are typically formed in one or two portions and made of a thermally conductive metal such as cast iron or copper. The water cooling of the burner and/or injector is achieved by a flow of water that follows a circuit (i.e., cooling channel) extending into, through, and out of the metal comprising the panel. Heat absorbed by the metal comprising the panel is transferred to the cooling water so that the panel does not get overheated. This is important because the burner and/or injector contacts the metal comprising the panel at the orifice. If the panel gets overheated, the burner and/or injector will get overheated. The panel can also break causing water leaks posing risk of an explosion.

Currently, there are many different water cooled burner and/or injector panel configurations that are commercially available. These water cooled burner and/or injector panels have a fixed cooling channel length and configuration which results in fixed level of cooling. While water cooled burner and/or injector panels can provide a satisfactory level of cooling for many areas inside an EAF, EAFs also include relatively cooler spots and relatively hotter spots.

Burner and/or injector panels exhibiting a useful lifetime in nominally hot spots often cannot withstand the much hotter conditions in very hot spots without premature failure. Thus, these panels need replacement sooner requiring the EAF to be shut down. Consequently, the long-term steel production rate is decreased. Even if the water cooled burner and/or injector panels that are designed for nominally hot conditions initially provide satisfactory resistance to the above-discussed harsh conditions, a change in the temperature pattern within the EAF can create very hot conditions adjacent that panel. As a result, the panel may still prematurely fail.

Alternatively, the EAF may include only those water cooled burner and/or injector panels that are specifically designed to satisfactorily withstand the harsher conditions of very hot spots. However, since water supplies are often limited at EAFS, the higher requirements for these specially designed panels may exceed the amount of water that is available.

The EAF could be provided with two different types of burner and/or injector panels (one for nominal conditions and one for very hot conditions). This last approach drives up the cost, complexity, and time for manufacturers because two different designs need to be created along with two different types of molds and two different manufacturing processes. It also makes maintenance more difficult.

Various burner panel configurations are disclosed in U.S. Pat. Nos. 4,703,336; 5,444,733; 6,212,218; 6,372,010; 5,166,950; 5,471,495; 6,289,035; 6,614,831; 5,373,530; 5,802,097; 6,999,495; and 6,342,086. Such prior art patents have proven to be beneficial. For example, U.S. Pat. No. 6,999,495 has found wide applicability for increasing spatial energy coverage in a furnace. Likewise, U.S. Pat. No. 6,614,831 has found applicability in extending the reach of various tools, such as a burner or a lance, into the interior of a furnace.

It is an object of the invention to provide a versatile water cooled burner and/or injector panel that overcomes the above deficiencies offered by current practices. More particularly, it is an object of the invention to provide a water cooled burner and/or injector panel that may be simply and economically adapted to nominally hot spots or to very hot spots within an EAF.

SUMMARY

There is disclosed a water cooled burner and/or injector panel kit for use in a melting furnace to cool a burner and/or an injector, comprising: a panel having first and second cooling water circuits and at least one orifice for mounting a burner and/or an injector, each of the circuits extending through an interior of the panel between an inlet and an outlet; and a removable flexible hose or rigid pipe adapted and configured to be reversibly connected to the outlet of the first circuit and to the inlet of the second circuit to allow water to flow, in order, into an inlet of the first circuit, through the first circuit, the removable hose or pipe, and the second circuit, and out of an outlet of the second circuit without leaking.

There is disclosed a water cooled burner and/or injector panel kit for use in a melting furnace to cool a burner and/or an injector, comprising: a panel having more than two cooling water circuits and at least one orifice for mounting a burner and/or an injector, each of the circuits extending through an interior of the panel between an inlet and an outlet; and at least three removable flexible hoses or rigid pipes each being adapted and configured to be reversibly connected to the outlet of one of the circuits and to the inlet of another of the circuit to allow water to flow, in order, into an inlet of one of the circuits, through that circuit, the removable flexible hose or rigid pipe in question, and another of the circuits, and out of an outlet of that circuit without leaking.

There is also disclosed a water cooled burner and/or injector panel apparatus kit for use in a melting furnace, comprising: a panel having first and second cooling water circuits and at least one orifice for mounting a burner and/or an injector, each of the circuits extending through an interior of the panel between an inlet and an outlet; a burner and/or injector inserted in the at least one orifice; and a removable flexible hose or rigid pipe adapted and configured to be reversibly connected to the outlet of the first circuit and to the inlet of the second circuit to allow water to flow, in order, into an inlet of the first circuit, through the first circuit, the removable pipe, and the second circuit, and out of an outlet of the second circuit without leaking.

There is also disclosed a water cooled burner and/or injector panel apparatus for use in a melting furnace, comprising: a panel having first and second cooling water circuits and at least one orifice for mounting a burner and/or an injector, each of the circuits extending through an interior of the panel between an inlet and an outlet; a burner and/or injector inserted in the at least one orifice; and a removable flexible hose or rigid pipe connected to the outlet of the first circuit and to the inlet of the second circuit to allow water to flow, in order, into an inlet of the first circuit, through the first circuit, the removable pipe, and the second circuit, and out of an outlet of the second circuit without leaking, the removable flexible hose or rigid pipe being adapted and configured to be reversibly disconnected to the outlet of the first circuit and to the inlet of the second circuit.

There is also disclosed a method of cooling the above-disclosed burner and/or injector panel apparatus kit that is mounted on a side wall of an EAF or on a balcony panel of an EAF, comprising the step of connecting the first and second circuits in parallel to a source of cooling water without connecting the two circuits with the flexible hose or rigid pipe.

There is also disclosed a method of cooling the above-disclosed burner and/or injector panel apparatus kit that is mounted on a side wall of an EAF or on a balcony panel of an EAF, comprising the step of connecting the first and second circuits in series to a source of cooling water by connecting the inlet or outlet of one of the two circuits to the inlet or outlet of the other of the two circuits with the flexible hose or rigid pipe.

By "connecting the first and second circuits in parallel to a source of cooling water", I mean that the cooling water is not used to first cool the burner and/or injector panel apparatus via one of the first and second circuits and then subsequently used to cool the burner and/or injector panel apparatus via the other of the first and second circuits. I also mean that the first and second circuits can receive cooling water from the same source of cooling water or from different sources of cooling water.

Any of the above-disclosed burner and/or injector panel kit, burner and/or injector panel apparatus kit, or methods may include one or more of the following aspects:

the panel includes one or more orifices accommodating one or more burners and/or injectors.

an inlet or outlet of one of the cooling circuits is connected to an inlet or outlet of the other of the cooling circuits with a flexible hose or rigid pipe so that the cooling circuits are cooled in series.

the flexible hose or rigid pipe is disconnected and the first and second circuits are connected in parallel to a source of cooling water without connecting the two circuits with the flexible hose or rigid pipe.

more than two cooling water circuits

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DETAILED DESCRIPTION

The water cooled burner and/or injector panel of the invention is made of heat conductive metal that has at least two independent cooling circuits extending through it. Each cooling circuit has an inlet and outlet projecting out the back face of the panel for connection to a water supply or water supplies. One of ordinary skill in the art will understand that the inlet and outlet of a given cooling circuit are interchangeable in that the flow direction of the cooling water need only be reversed to change an inlet to an outlet and vice versa. Maximum cooling may be achieved when each cooling circuit is connected to a cooling water source in parallel. By connection to a cooling water source in parallel, I mean that the cooling water is not first heated to a higher temperature in one of the circuits before it flows through the other of the circuits and that each circuit is either connected to different sources of cooling water or they are separately connected to the same source of cooling water. In the event that maximum cooling is not needed and it is more important to conserve water, either the inlet or the outlet of the first cooling circuit is connected to either the inlet or outlet of the second cooling circuit via a flexible hose or rigid pipe. Thus, the hose or pipe is behind the rear face of the panel. The non-connected inlet or outlet of the first cooling circuit and the non-connected inlet or outlet of the second cooling circuit then become the inlet/outlet (or outlet/inlet) for a single source of cooling water to flow through the panel. In this manner, the two circuits are cooled in series.

Figure 1:
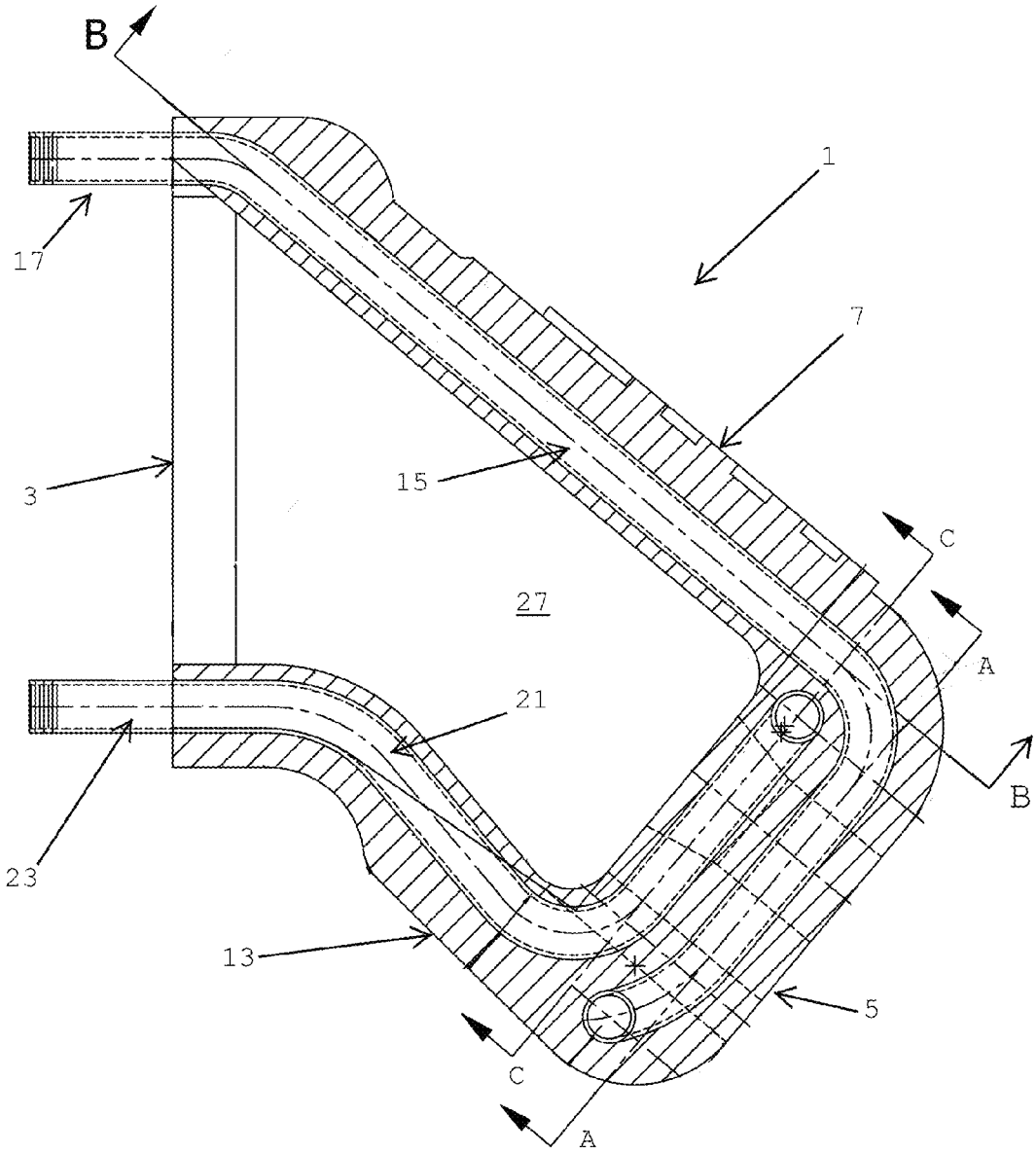
FIG. 1 is a cross-sectional schematic view of a particular embodiment of the water cooled burner and/or injector panel of the invention, the cross-section being taken along a vertical plane that is perpendicular to the back face of the panel and which is disposed to the side of the middle of the panel.
Figure 2:
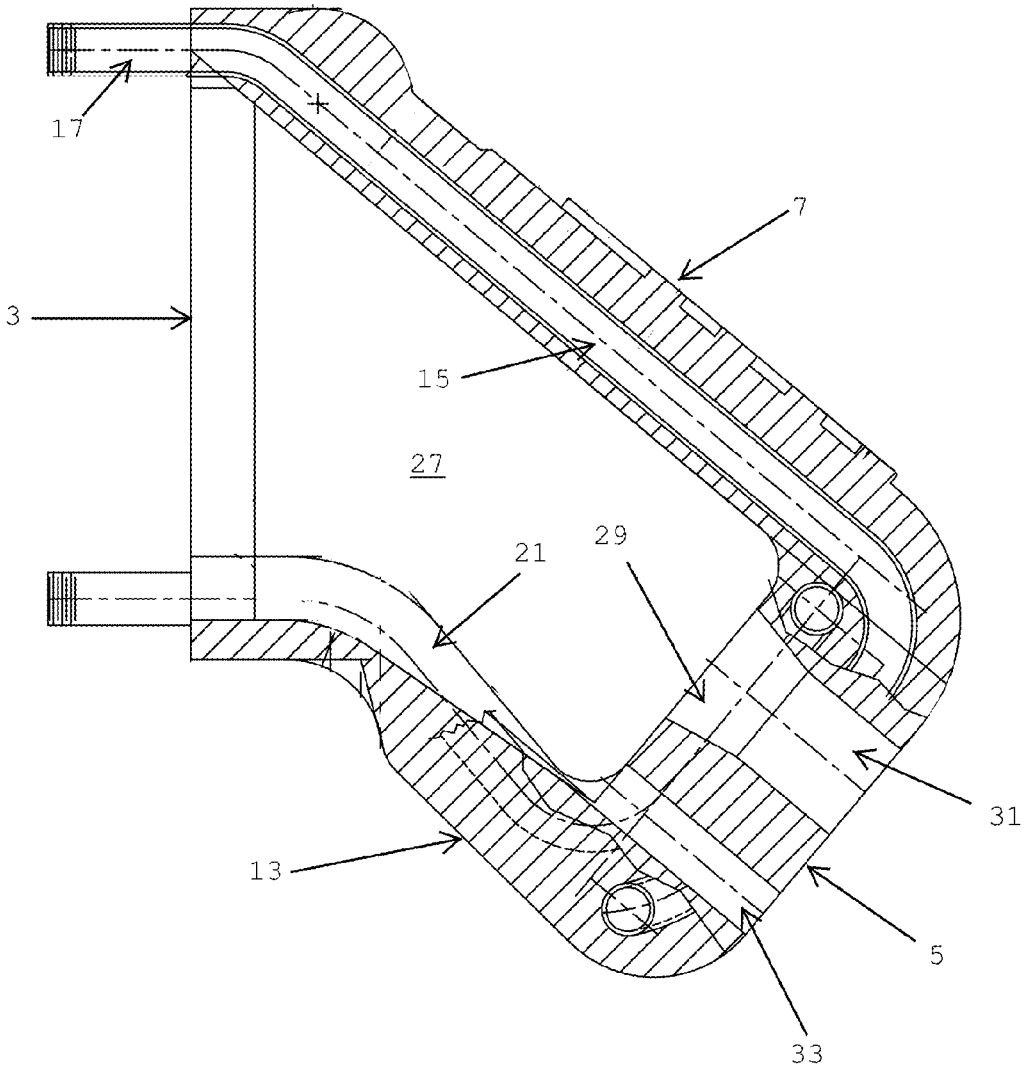
FIG. 2 is a cross-sectional schematic view of the panel of FIG. 1, the cross-section being taken along a vertical plane that is perpendicular to the back face of the panel and which is disposed in the middle of the panel.
Figure 3:
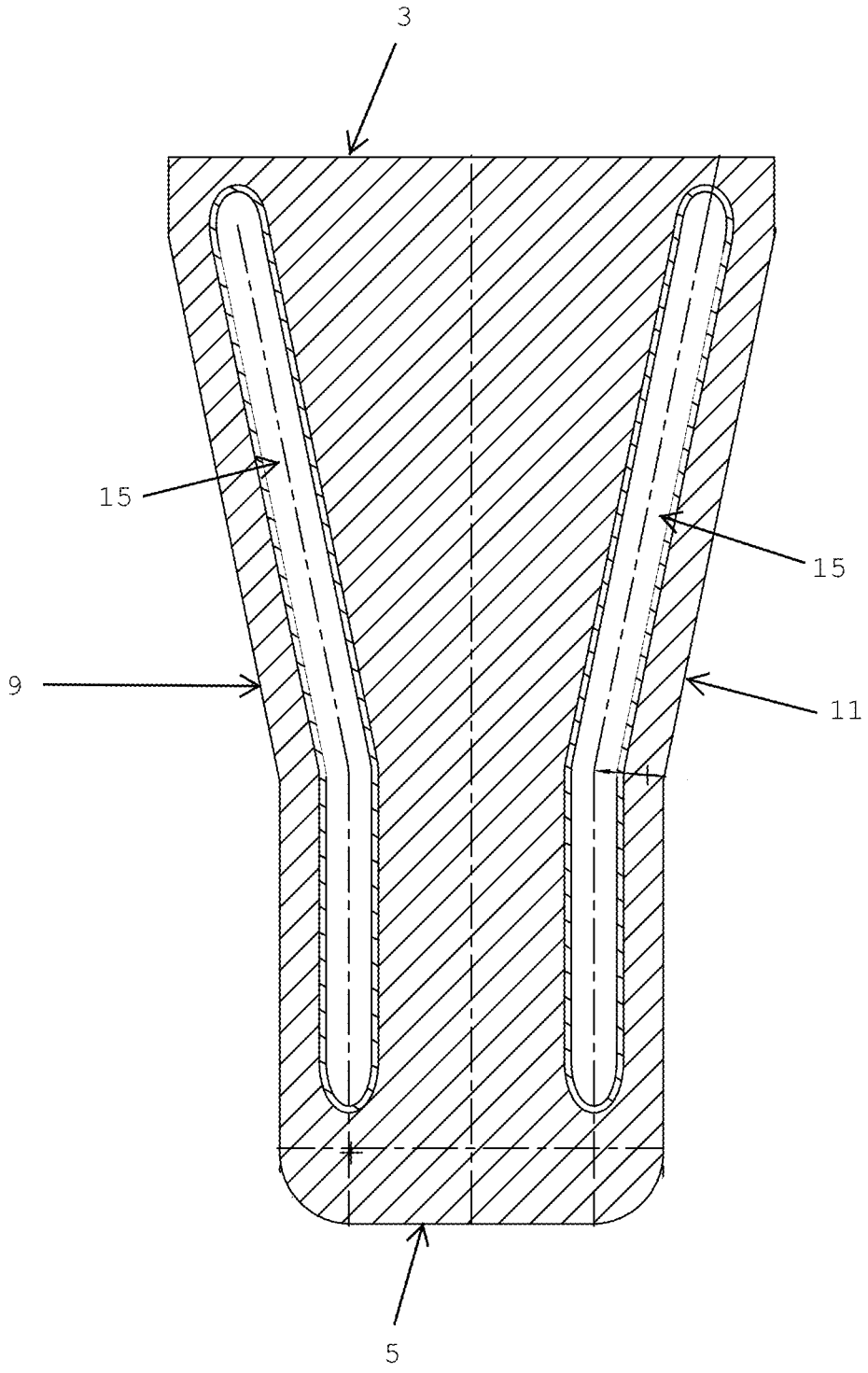
FIG. 3 is a cross-sectional schematic view of the panel of FIG. 1 taken along B-B.
Figure 4:
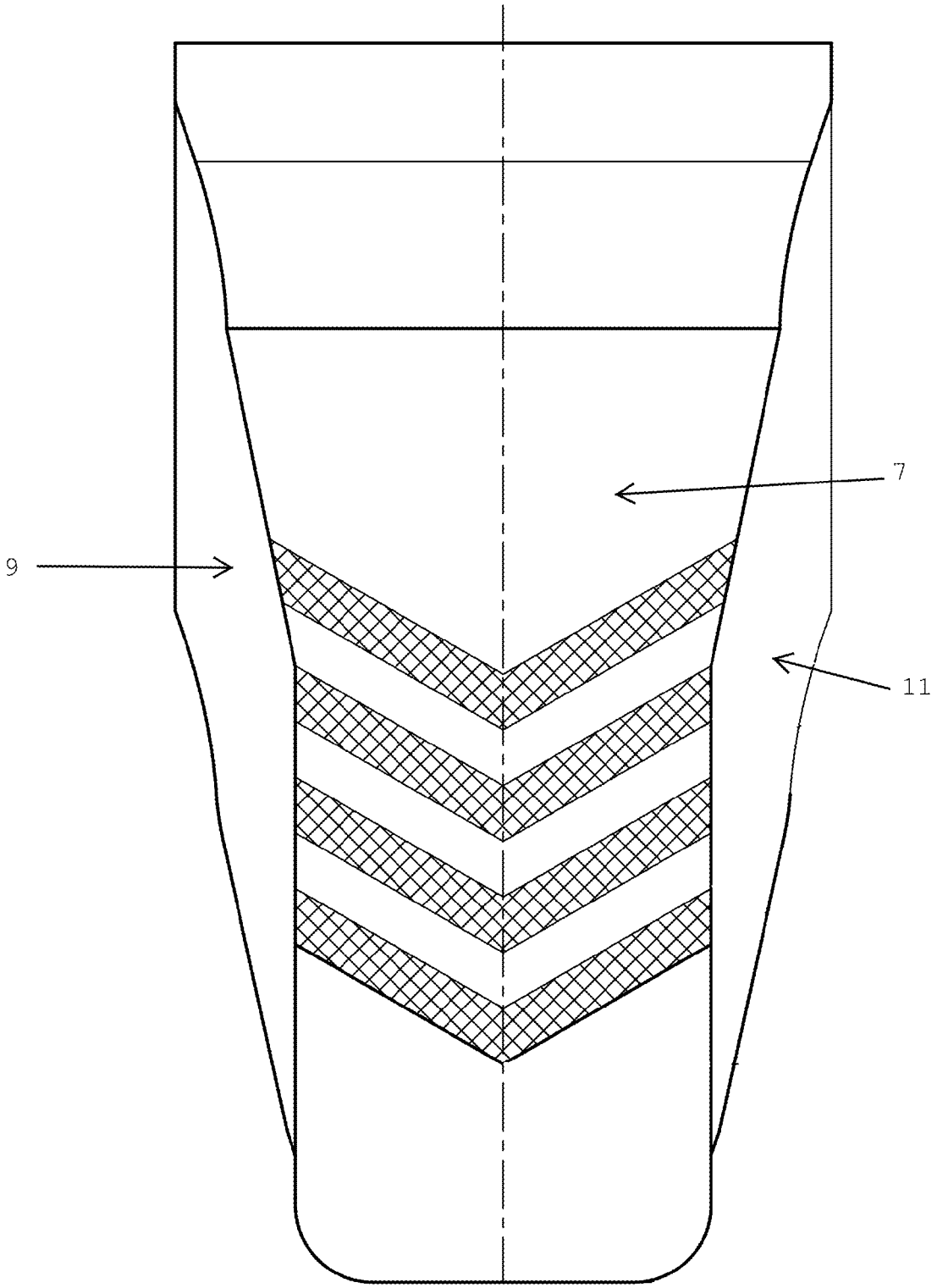
FIG. 4 is a top view of the panel of FIG. 1 without the inlets and outlets of the cooling circuits.
Figure 5:
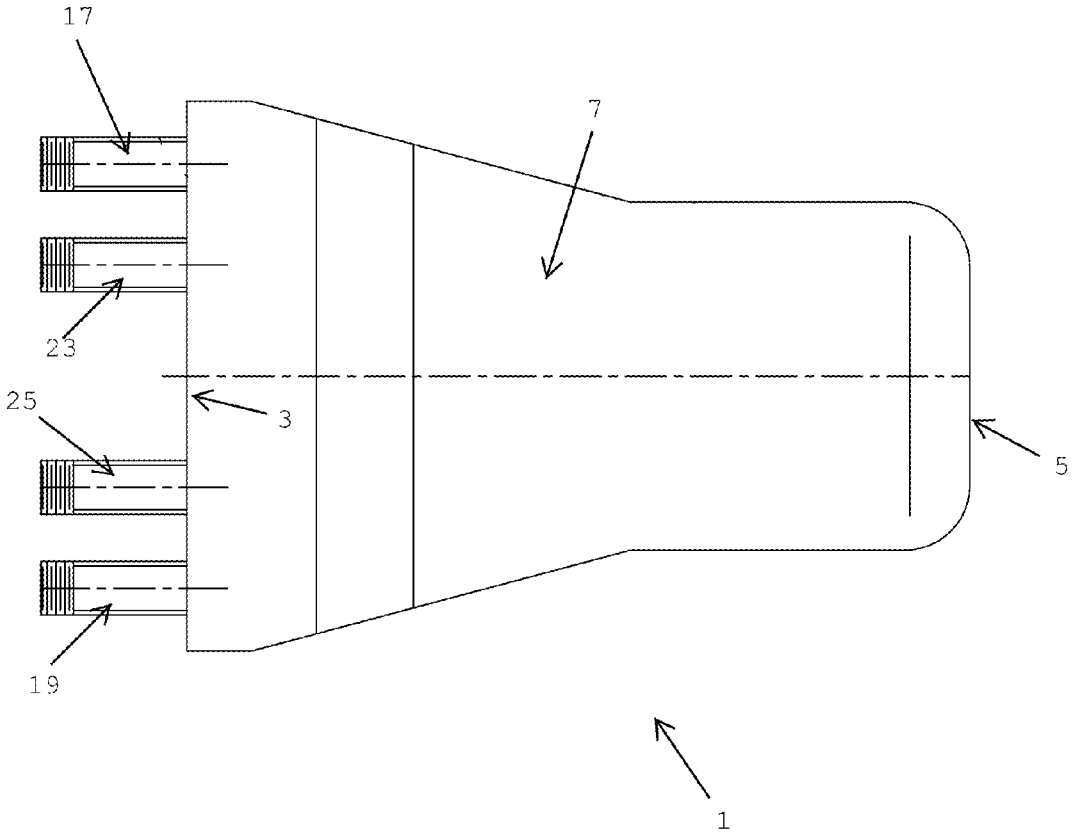
FIG. 5 is a bottom view of the panel of FIG. 1.
Figure 6:
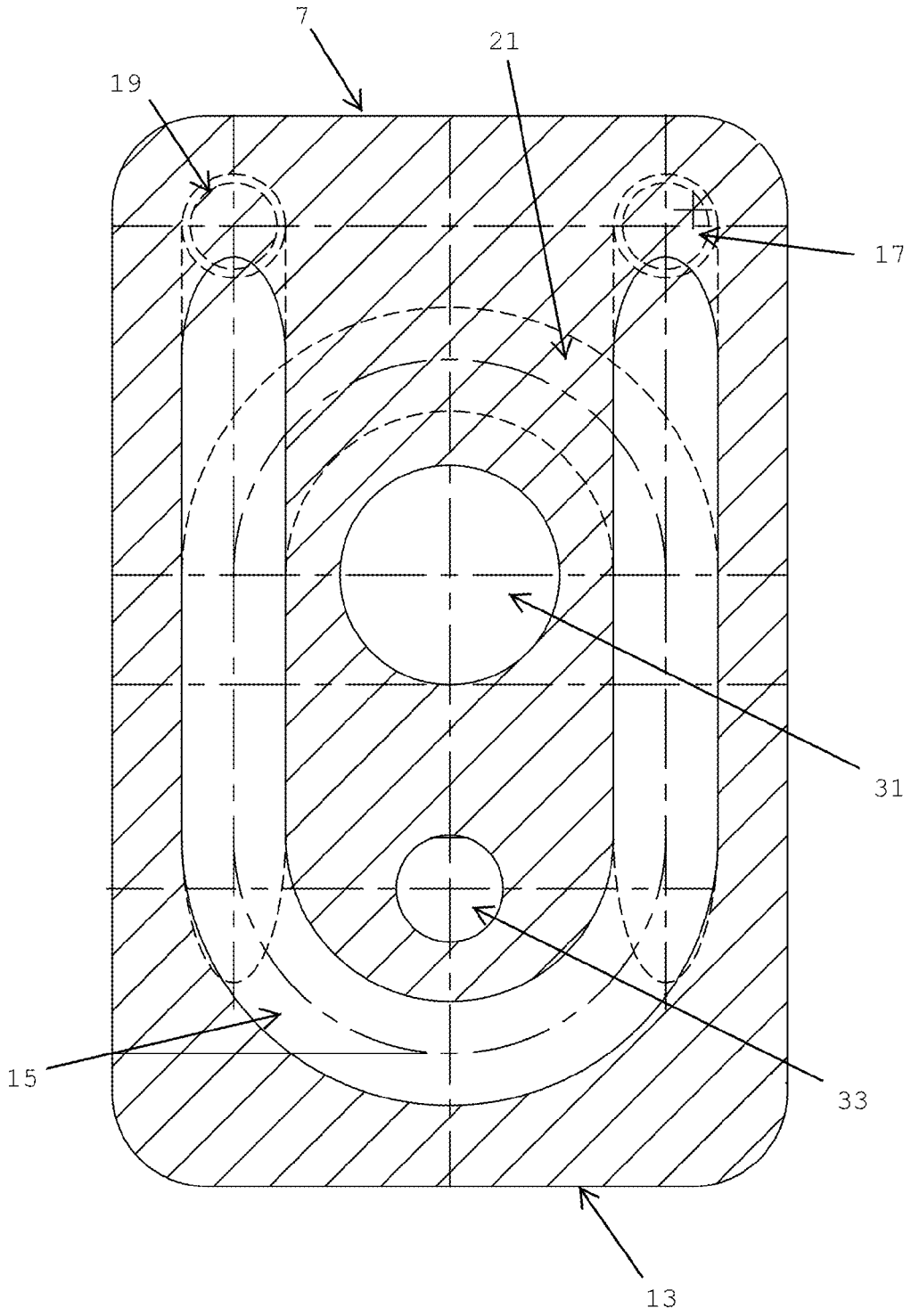
FIG. 6 is a cross-sectional schematic view of the panel of FIG. 1 taken along A-A.
Figure 7:
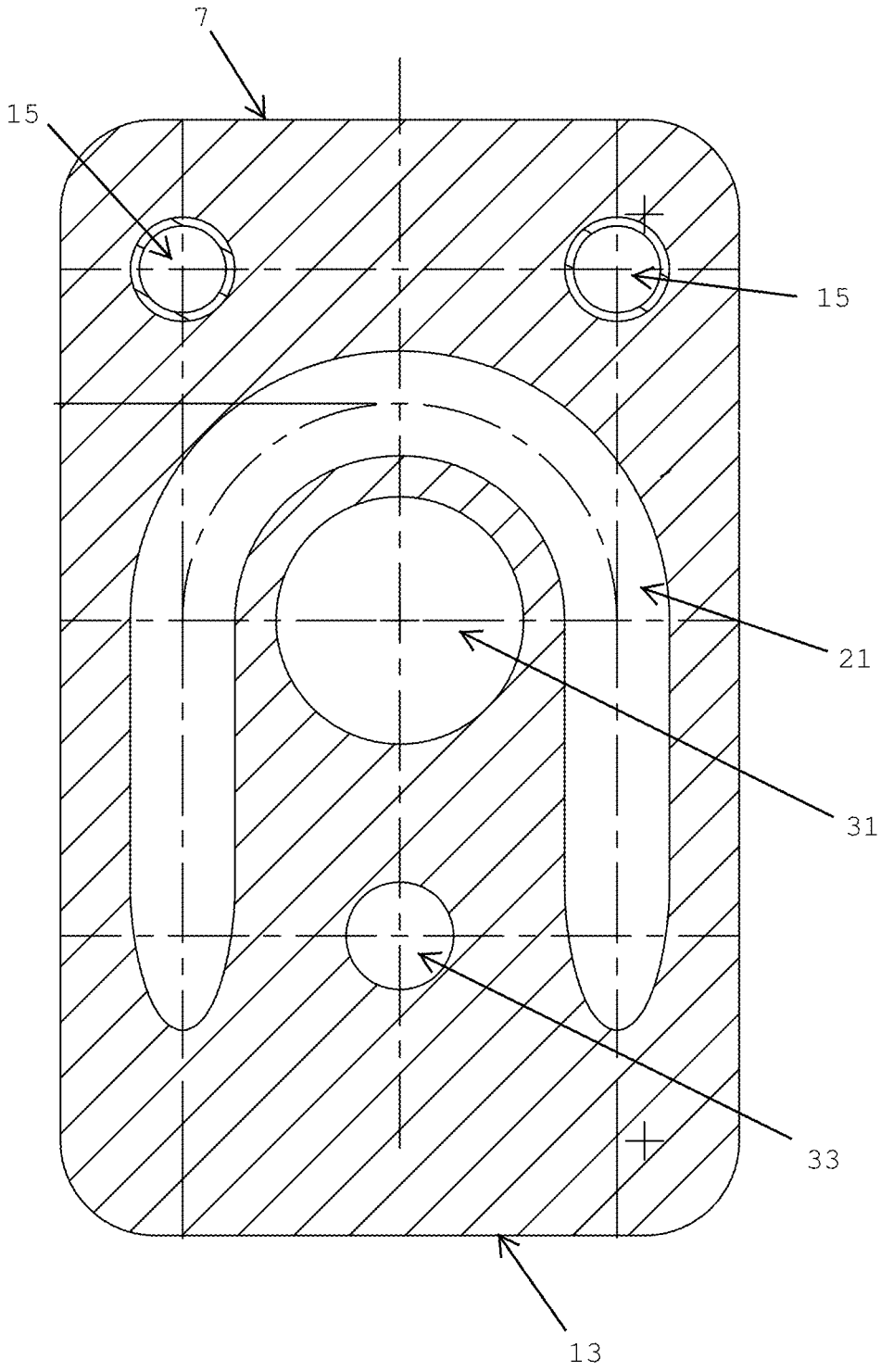
FIG. 7 is a cross-sectional schematic view of the panel of FIG. 1 taken along C-C.
Figure 8:
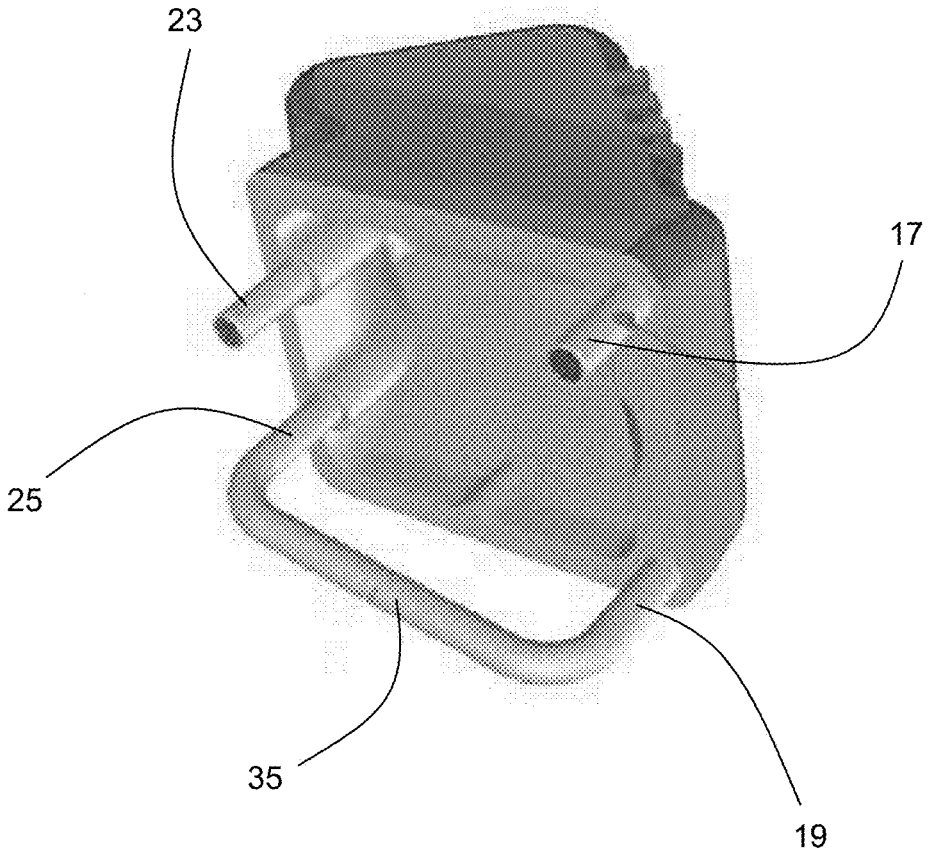
FIG. 8 is an isometric view of the panel of FIG. 1 with the flexible hose or rigid pipe connecting the two cooling water circuits.

As best illustrated in FIGS. 1-8, the water cooled burner and/or injector panel includes a main body 1 having a back face 3, a front face 5, a top face 7, a right face 9, a left face 11, and a bottom face 13. Extending through the main body 1 is a first cooling circuit 15 having an inlet 17 and outlet 19 each of which projects out of the back face 3. The main body 1 also includes a second cooling circuit 21 having an inlet 23 and outlet 25 similarly projecting out of the back face 3. The main body 1 has a cavity 27 which extends from the back face 3 to a point just in behind the second cooling circuit 21. The cavity 27 provides a space through which a burner and injector may be inserted into the panel. Fluidly communicating with the cavity 27 is a burner orifice 29 for accommodating insertion of a burner into the panel. Leading from the burner orifice 29 is a combustion chamber 31. When inserted, the burner terminates at the interface of the burner orifice 29 and the combustion chamber 31. The jets of oxidant and fuel injected by the burner begin mixing in the combustion chamber 31 before they are fully expanded and form a flame outside the front face 5. Also fluidly communicating with the cavity is an injector orifice 33 for accommodating insertion of an injector into the panel. The flexible hose or rigid pipe 35 connects the first circuit outlet 19 with the second circuit outlet 25.

One of ordinary skill in the art will recognize that the terms inlet and outlet are not meant to limit the flow direction of the cooling water. Rather, depending upon which flow direction is desired, the second circuit outlet 25 can actually serve as an inlet receiving the cooling water in which case the second circuit inlet 23 would actually serve as an outlet from which the cooling water would exit the burner and/or injector panel apparatus. Moreover, the skilled artisan will recognize that the flexible hose or rigid pipe 35 can be used to connect either of the first circuit inlet or outlet 17, 19 with either of the second circuit inlet or outlet 23, 25.

The panel may be made of a thermally conductive metal, such as cast iron, copper, and copper alloys. Flexible hoses and rigid pipes are well known in the plumbing and cooling water arts and their details need not be duplicated herein.

The cooling circuits of the burner and/or injector panel may be cast in one of two ways. In the first way, a metal pipe is bent into the desired configuration, inserted and fixed inside a casting form. Molten metal is then poured into the form. In the second way, a sand core of the desired configuration fashioned from dies is inserted and fixed inside a casting form. Molten metal is then poured into the form.

The burner and/or injector panel may be mounted on a side wall of an EAF or in a balcony panel (i.e., the "banana panel") of a sump area of an EAF furnace.

Any one of the known burners or injectors or burners and injectors may be implemented with the panel of the invention. While not limited as such, the burners typically inject jets of gaseous fuel such as natural gas and oxidant such as air, oxygen-enriched air, or industrially pure oxygen. Again while not limited as such, the injectors are adapted and configured to inject oxygen (such as from a lance) or solid particulate matter (such as carbon).

It may then been seen that the problems associated with conventional burner and/or injector panels are solved. Instead of subjecting a single panel design to premature failure when mounted in an especially hot spot or unsatisfactorily taxing the water supply at the EAF using panels designed for very high temperatures, I propose the use of a single panel design that may be easily adapted to either nominally hot positions within the furnace or very hot positions within the furnace. Connection of the two or more independent cooling circuits with a flexible hose or rigid pipe allows use of the panel for nominally hot temperature environments. Disconnection of the two or more independent cooling circuits and connection of them to two or more different sources of cooling water allows use of the panel for very high temperature environments.

Preferred processes and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

What is claimed is:

1. A water cooled burner and/or injector panel kit for use in a melting furnace to cool a burner and/or an injector, comprising:

a panel having first and second cooling water circuits and at least one orifice for mounting a burner and/or an injector, the panel also having a back face, a front face, a top face, a right face, and a bottom face, the first cooling circuit extending through an interior of the panel between an associated inlet and an associated outlet each of which projects out of the back face, the second cooling circuit also extending through an interior of the panel between an associated inlet and an associated outlet each of which projects out of the back face; and a removable flexible hose or rigid pipe adapted and configured to be reversibly connected to the outlet of the first circuit and to the inlet of the second circuit to allow water to flow, in order, into an inlet of the first circuit, through the first circuit, the removable hose or pipe, and the second circuit, and out of an outlet of the second circuit without leaking.

2. The burner and/or injector panel kit of claim 1, wherein the panel includes one or more orifices accommodating one or more burners and/or injectors.

3. A water cooled burner and/or injector panel apparatus kit for use in a melting furnace, comprising:

a panel having first and second cooling water circuits and at least one orifice for mounting a burner and/or an injector, the panel also having a back face, a front face, a top face, a right face, and a bottom face, the first cooling circuit extending through an interior of the panel between an associated inlet and an associated outlet each of which projects out of the back face, the second cooling circuit also extending through an interior of the panel between an associated inlet and an associated outlet each of which projects out of the back face;

a burner and/or injector inserted in the at least one orifice; and a removable flexible hose or rigid pipe adapted and configured to be reversibly connected to the outlet of the first circuit and to the inlet of the second circuit to allow water to flow, in order, into an inlet of the first circuit, through the first circuit, the removable pipe, and the second circuit, and out of an outlet of the second circuit without leaking.

4. A method of cooling the burner and/or injector panel apparatus kit of claim 3 that is mounted on a side wall of an EAF or on a balcony panel of an EAF, comprising the step of connecting the first and second circuits in parallel to a source of cooling water without connecting the two circuits with the flexible hose or rigid pipe.

5. The method of claim 4, further comprising the step of connecting an inlet or outlet of one of the cooling circuits to an inlet or outlet of the other of the cooling circuits with a flexible hose or rigid pipe so that the cooling circuits are cooled in series.

6. A method of cooling the burner and/or injector panel apparatus kit of claim 3 that is mounted on a side wall of an EAF or on a balcony panel of an EAF, comprising the steps of:

connecting the first and second circuits in series to a source of cooling water by connecting the inlet or outlet of one of the two circuits to the inlet or outlet of the other of the two circuits with the flexible hose or rigid pipe.

7. A method of cooling a burner and/or injector panel apparatus kit that is mounted on a side wall of an EAF or on a balcony panel of an EAF, the burner and/or injector panel apparatus kit comprising:

a panel having first and second cooling water circuits and at least one orifice for mounting a burner and/or an injector, the panel also having a back face, a front face, a top face, a right face, and a bottom face, the first cooling circuit extending through an interior of the panel between an associated inlet and an associated outlet each of which projects out of the back face, the second cooling circuit also extending through an interior of the panel between an associated inlet and an associated outlet each of which projects out of the back face;

a burner and/or injector inserted in the at least one orifice; and a removable flexible hose or rigid pipe adapted and configured to be reversibly connected to the outlet of the first circuit and to the inlet of the second circuit to allow water to flow, in order, into an inlet of the first circuit, through the first circuit, the removable pipe, and the second circuit, and out of an outlet of the second circuit without leaking, wherein said method comprises the steps of:

connecting the first and second circuits in series to a source of cooling water by connecting the inlet or outlet of one of the two circuits to the inlet or outlet of the other of the two circuits with the flexible hose or rigid pipe; and disconnecting the flexible hose or rigid pipe and connecting the first and second circuits in parallel to a source of cooling water without connecting the two circuits with the flexible hose or rigid pipe.

* * * * *